US011608594B2

(12) United States Patent
Koeckritz et al.

(10) Patent No.: US 11,608,594 B2
(45) **Date of Patent: *Mar. 21, 2023**

(54) PAPER MACHINE CLOTHING AND METHOD OF PRODUCING THE SAME

(71) Applicant: VOITH PATENT GMBH, Heidenheim (DE)

(72) Inventors: Uwe Koeckritz, Heidenheim (DE); Reinhard Holl, Lauingen (DE); Michael Straub, Steinheim (DE); Jens Kallenberg, Herbrechtingen (DE); Timo Kalefe, Sontheim (DE); Tom Meijer, Doesburg (NL); Johan Bergvall, Vastervik (SE); Johann Boeck, Fornach (AT)

(73) Assignee: Voith Patent GmbH, Heidenheim (DE)

( * ) Notice: Subject to any disclaimer, the term of this patent is extended or adjusted under 35 U.S.C. 154(b) by 225 days.

This patent is subject to a terminal disclaimer.

(21) Appl. No.: 17/045,547

(22) PCT Filed: Apr. 16, 2019

(86) PCT No.: PCT/EP2019/059753

§ 371 (c)(1),
(2) Date: Oct. 6, 2020

(87) PCT Pub. No.: WO2019/206734

PCT Pub. Date: Oct. 31, 2019

(65) Prior Publication Data

US 2021/0156088 A1 May 27, 2021

(30) Foreign Application Priority Data

Apr. 23, 2018 (EP) ..... 18168641
Jun. 27, 2018 (EP) ..... 18180071

(51) Int. Cl.
*D21F 1/00* (2006.01)
*D21F 7/08* (2006.01)

(52) U.S. Cl.
CPC ..... *D21F 1/0027* (2013.01); *D21F 1/0063* (2013.01); *D21F 7/08* (2013.01)

(58) Field of Classification Search
CPC .... D21F 1/0027; D21F 1/0036; D21F 1/0045; D21F 1/0063; D21F 1/0081; D21F 7/08; D21F 7/083; D21F 7/12
(Continued)

(56) References Cited

U.S. PATENT DOCUMENTS 4,446,187 A 5/1984 Eklund
4,541,895 A 9/1985 Albert
(Continued)

FOREIGN PATENT DOCUMENTS

DE 102010040089 A1 3/2012
EP 3348708 A1 7/2018
(Continued)

*Primary Examiner* — Eric Hug
(74) *Attorney, Agent, or Firm* — Laurence A. Greenberg; Werner H. Stemer; Ralph E. Locher

(57) ABSTRACT

A paper machine clothing has a substrate with an upper side, a lower side, two lateral edges and a usable region between the two lateral edges. The usable region is formed with a plurality of through-channels extending through the substrate and connecting the upper side with the lower side. The through-channels are non-cylindrical with a cross sectional area becoming smaller when going in a thickness direction of the substrate from the upper side to a middle region of the substrate between the upper side and the lower side, wherein a shape of the cross sectional area of at least one through-channel, preferably of all through-channels, of the plurality
(Continued)

of through-channels changes proceeding in the thickness direction of the substrate from the upper side to the lower side.

20 Claims, 3 Drawing Sheets

(58) Field of Classification Search
USPC ..... 162/348, 358.2, 900, 902, 903
See application file for complete search history.

(56) References Cited

U.S. PATENT DOCUMENTS

| | | | | |
|---|---|---|---|---|
| 5,837,102 | A | 11/1998 | Graf | |
| 8,815,057 | B2 | 8/2014 | Eberhardt et al. | |
| 11,060,241 | B2 * | 7/2021 | Koeckritz | D21F 1/0027 |
| 2006/0096961 | A1 * | 5/2006 | Kahkonen | B26F 1/26<br>219/121.72 |
| 2010/0236740 | A1 * | 9/2010 | Mourad | D21F 1/0036<br>83/30 |

FOREIGN PATENT DOCUMENTS

| | | | | |
|---|---|---|---|---|
| EP | 3561176 | A1 | 10/2019 | |
| WO | 9102642 | A1 | 3/1991 | |
| WO | WO 91/02642 | * | 3/1991 | B29C 65/48 |
| WO | 2010088283 | A1 | 8/2010 | |

* cited by examiner

A-A, B-B, C-C:

D-D:

E-E, F-F, G-G:

H-H:

PAPER MACHINE CLOTHING AND METHOD OF PRODUCING THE SAME

BACKGROUND OF THE INVENTION

Field of the Invention

The present invention concerns a paper machine clothing comprising a substrate with an upper side, a lower side, two lateral edges and an usable region between the two lateral edges, wherein the usable region comprises a plurality of through-channels extending through the substrate and connecting the upper side with the lower side, wherein the through-channels are non-cylindrical with a cross sectional area becoming smaller when going in a thickness direction of the substrate from the upper side to a middle region of the substrate between the upper side and the lower side. Another aspect of the present invention concerns a method of producing such a paper machine clothing.

In the sense of the present invention the term "paper machine clothing", abbreviated "PMC", refers to any kind of a rotating clothing used to transport a nascent or already formed fiber web in a machine that is designed to continuously produce and/or finish a fiber web, such as paper, tissue or board material. For historical reasons, PMC is sometimes also called wire, felt or fabric. In particular, PMC can be a forming wire or a dryer fabric or a press felt, depending upon its intended use in the corresponding machine. Furthermore, in the sense of the present invention the term PMC may also refer to any kind of clothing used in wet and/or dry production of fibrous nonwovens.

The term "substrate" in the sense of the present invention refers to some kind of foil material made of plastic. The substrate itself is usually impermeable to water, so that through-channels are needed to obtain a desired permeability, e.g. for dewatering the nascent fiber web or further drying the already formed fiber web. The substrate can be formed monolithic or comprise several layers that might be co-extruded or produced separately and laminated together afterwards. After joining the longitudinal ends of the substrate to each other, e.g. by laser welding, to obtain some kind of an endless belt, the perforated substrate may already represent the final product, for example a forming wire. For other applications, further steps might be necessary to produce the final PMC, such as permanently attaching fibers thereto to form a press felt. Furthermore, the substrate may comprise a reinforcing structure, such as yarns, that may be imbedded therein. After joining the longitudinal ends of the substrate to each other, the "upper side" of the substrate shall be the radially outer side, sometimes also referred to as "paper side", whereas the "lower side" of the substrate shall be the radially inner side, sometimes also referred to as "machine side". The substrate is preferably laser-drilled to provide the through-channels.

The idea of producing a PMC from a substrate that is perforated, especially by using a laser, is already known for quite a long time in the prior art and described e.g. in the 1980's and 1990's in the documents U.S. Pat. Nos. 4,541,895A and 5,837,102, respectively, the content of which is hereby incorporated by reference. FIG. 1 illustrates the processes of perforating a substrate via laser drilling according to the U.S. Pat. No. 5,837,102 reference. FIG. 1 only shows a portion of a substrate 20' used to produce a PMC forming fabric. The substrate 20' has a first surface 22' and an opposite second surface that is not shown in the figure. Even though the first surface 22' may be embossed it can be considered as being substantially plane and parallel to the second surface. The substrate 20' is perforated using a laser beam LB from a laser that is connected to a controller so as to drill a plurality of discrete through-channels 30' into the substrate 20'. The through-channels 30' connect the side of the first surface 22' with the side of the opposite second surface of the substrate 20'. The through-channels 30' extend in the thickness direction TD of the substrate 20', i.e. perpendicular to the first surface 22' and the second surface.

In the sense of the present invention the term "usable region" refers to a region of the PMC that is actually used for the production and/or finishing of the fiber web. The usable region may span the complete width of the PMC, i.e. may reach from one lateral edge to the other lateral edge thereof. Alternatively, the usable region may refer only to a region that is located between the two lateral edges and is spaced apart from the two lateral edges. In the latter case, the PMC may have another configuration, such as permeability and thickness, outside the usable region compared to the usable region.

The term "cross sectional area" of a through-channel in the sense of the present invention refers to an area of the through-channel that is obtained by cutting the through-channel with a plane that is perpendicular to the thickness direction of the substrate.

The term "non-cylindrical" in the sense of the present invention means that there are at least two different cross sectional areas of a through-channel. For example, in the case of a non-cylindrical through channel that is substantially conical, a cross sectional area taken at a first plane perpendicular to the thickness direction of the substrate may be substantially circular having a first radius, whereas another cross sectional area taken at a second plane perpendicular to the thickness direction of the substrate may be also substantially circular but having a second radius that differs from the first radius.

A relevant paper machine clothing is known for example from the disclosure of documents U.S. Pat. No. 4,446,187 and DE 10 2010 040 089 A1, the content of which is hereby incorporated by reference. FIGS. 2, 3*a*, 3*b* and 3*c* are based on the disclosure of U.S. Pat. No. 4,446,187. It is also known from the disclosure of documents WO 91/02642 A1 and WO 2010/088283 A1.

FIG. 2 shows a substrate 20' that is placed under tension between two rollers R. The substrate 20' has a radially outer, first surface 22' and an opposite, radially inner, second surface 24', as can be seen in FIGS. 3*a*, 3*b* and 3*c*. The first surface 22' and the second surface 24' are planar and parallel to each other. The thickness direction TD is oriented perpendicular to the first surface 22' and the second surface 24'. The substrate 20' further comprises a first lateral edge 26' and a second lateral edge 28'. In this example, the usable region of the substrate 20' extends in width direction WD of the substrate 20' the full way from the first lateral edge 26' to the second lateral edge 28'. In the usable region the substrate 20' is perforated by a laser that is drilling a plurality of discrete through-channels 30' into the substrate 20'. As indicated in FIG. 2 the laser first makes the through-channels 30' close to the first lateral edge 26' in a first row and continues moving across the substrate 20' to the through-channel 30' close to the second lateral edge 28' at the end of the same row. Thereafter, the laser is displaced by one row to make another through-channel 30' close to the first lateral edge 26' in a next row.

FIGS. 3*a*, 3*b* and 3*c* show different possible configurations of the through-channels 30'. In FIG. 3*a* the through-channel is cylindrical having the same cross sectional area at any location along the thickness direction TD of the substrate 20'. In FIG. 3*b* the through-channel 30' is conical wherein the cross sectional area of the through-channel 30' close to the first surface 22' is larger than the cross sectional area of the through-channel 30' close to the second surface 24'. In FIG. 3*c* the through-channel 30' is neither cylindrical nor conical. Instead it resembles a hyperboloid having a cross sectional area that is also always of a circular shape, like in the previous two examples, but the radius of this circle is first decreasing when going in thickness direction TD from the first surface 22' to a middle region MR of the substrate 20' situated in the thickness direction TD between the first surface 22' and the second surface 24', and is then increasing again when further going from the middle region MR of the substrate 20' to the second surface 24'.

Fiber retention, permeability and the degree of marking are characteristic parameters of a PMC that are important in view of the quality of the fiber web that is to be produced and/or finished on the PMC. With the paper machine clothing known from the prior art there is still room for improvement.

SUMMARY OF THE INVENTION

Thus, it is an object of the present invention to provide a paper machine clothing with improved characteristics compared to the known paper machine clothing, thereby allowing to produce a fiber web of very high quality.

This object is achieved by a paper machine clothing as claimed, as well as by a method of producing the same as claimed. Advantageous embodiments are the subject-matter of the dependent claims.

Thus, according to the invention, a paper machine clothing as initially described is provided wherein a shape of the cross sectional area of at least one through-channel, preferably of all through-channels, of the plurality of through-channels changes when going in the thickness direction of the substrate from the upper side to the lower side.

That the shape of the cross sectional area changes does not mean that the same shape, e.g. circular, is just scaled in size but means that the shape itself changes, e.g. from elliptical to circular. For example, the through-channels of the prior art embodiments shown in FIGS. 3*a*, 3*b* and 3*c* have always a cross sectional area of a circular shape independently of the location along the thickness direction where the cross sectional area is taken.

Advantageously, the shape of the cross sectional area is substantially more elliptical in an upper region of the through-channel than in a lower region of the through-channel. In mathematics, an ellipse is a curve in a plane surrounding two focal points such that the sum of the distances to the two focal points is constant for every point on the curve. As such, it is a generalization of a circle, which is a special type of an ellipse having both focal points at the same location. The shape of an ellipse (how "elongated" it is) is represented by its eccentricity, which for an ellipse can be any number from 0 (the limiting case of a circle) to arbitrarily close to but less than 1. Consequently, "the cross sectional area being substantially more elliptical in an upper region of the through-channel than in a lower region of the through-channel" means that the shape of the cross sectional area changes as the eccentricity of the substantially elliptically shaped cross sectional area in the upper region of the through-channel is larger than the eccentricity of the substantially elliptically shaped cross sectional area in the lower region of the through-channel, wherein the latter one might be even 0 (corresponding to a circle). Thereby, the value of the eccentricity may diminish continuously in thickness direction.

Of course, the terms "elliptical" and "circular" when used in view of the cross sectional areas of the through-channels must not be understood in a strict mathematical way but some deviations, e.g. due to manufacturing tolerances, are allowed. Therefore, the term "elliptical" may be rather understood as "oval" as also described in previously mentioned prior art documents WO 91/02642 A1 and WO 2010/088283 A1.

In view of the through-channels 30' described with respect to FIGS. 3*a*, 3*b* and 3*c*, the basic shape of the cross sectional area of the through-channels 30' is always the same, i.e. circular. However, it turned out to be advantageous—for reasons explained in more detail below—if the cross sectional area of the through-channels 30' changes along the thickness direction of the substrate, in particular if the cross sectional area is more elliptical close to the upper side of the substrate and more circular close to the lower side of the substrate. If the through-channels are drilled by a laser, such a form of the through-channels can be achieved for example by not shutting off of the laser or by at least not shutting off completely the laser when advancing with the laser from one through-channel to the next neighboring through-channel in a row. Applying this method can result in that the upper rim of a through-channel is deeper below the original first surface of the substrate at a point between two neighboring through-channels in the direction of advancement of the laser compared to a point between two neighboring through-channels in a direction perpendicular thereto.

According to the present invention it is possible to impart anisotropic properties to the substrate in a beneficial way. For example, it is proposed that the shape of the cross sectional area in the upper region of the through-channel has a first dimension extending in cross-machine direction and a second dimension extending in machine direction, wherein the first dimension is smaller than the second dimension. Thus, the "first direction" can correspond to the minor axis of a substantially elliptical shaped cross sectional area, whereas the "second direction" can correspond to the major axis of the substantially elliptical shaped cross sectional area. With such a configuration of the through-channels the substrate, and thus the final paper machine clothing, can stand higher stress in the machine direction compared to the cross machine direction, wherein stresses that act on the paper machine clothing are usually in fact much higher in the machine direction than in the cross machine direction. As it is clear to those skilled in the art, the term "machine direction" refers to the longitudinal direction of the PMC, i.e. the direction of transportation of the fiber web or the fibrous nonwoven when the PMC is installed in a corresponding machine, whereas the term "cross machine direction" refers to a direction within the plane of the PMC that is perpendicular to the machine direction.

In an alternative embodiment it is proposed that the shape of the cross sectional area in the upper region of the through-channel has a first dimension extending in cross-machine direction and a second dimension extending in machine direction, wherein the first dimension is larger than the second dimension. Thus, the "first direction" can correspond to the major axis of a substantially elliptical shaped cross sectional area, whereas the "second direction" can correspond to the minor axis of the substantially elliptical shaped cross sectional area. Such a form of the through-channels is particularly beneficial if the fiber retention on the paper machine clothing, in particular a forming fabric, shall be enhanced.

The first dimension and the second dimension preferably differ from each other by at least 5%, more preferably by at least 10%, and even more preferably by at least 15%, of the respective smaller dimension.

Preferably, on the lower side of the substrate the shape of the cross sectional area is substantially circular.

Preferably an upper rim of at least one of the plurality of through-channels directly contacts an upper rim of at least one other neighboring through-channel of the plurality of through-channels. More preferably this applies substantially to all through-channels and to all their neighboring through-channels formed within the usable region of the substrate. In the sense of the present invention the term "neighboring" could be replaced by the term "adjacent", meaning that there is no other through-channel placed between two neighboring or adjacent through-channels. Furthermore, in the sense of the present invention the term "upper rim" of a through-channel refers to the rim of the through-channel on the upper side of the substrate. The rim itself may be defined as a closed line where the sidewall of the through-channel ends. In view of the previously described examples of the prior art, the upper rim can be easily identified, always being completely surrounded by the first surface 22'. To be more specific, in these examples, the upper rim is always a circular line lying within the plane of the first surface 22' of the substrate 20'. In contrast, according to the present invention, the upper rim of a through-channel may not lie within a plane. This is particularly true when two neighboring through-channels partially "intersect" or "overlap" each other on the upper side of the substrate. The upper rim may then partially be surrounded or defined by portions of the still existing first surface of the substrate and partially by the sidewall of at least one neighboring through-channel. In an alternative embodiment of the present invention, the upper rim of a through-channel may be even completely surrounded or defined by the respective upper rims of the neighboring through-channels. In the latter case, the original first surface of the substrate, i.e. the surface that was substantially plane and parallel to the second surface of the substrate before the perforation of the substrate, may have been completely lost in the usable region of the substrate. The topography of the substrate after the perforation process may somehow resemble the topography of an egg box.

In the known prior art, the through-channels are always formed as discrete holes being clearly spaced apart from one another with the respective upper rims of the through-channels being fully surrounded or defined by the first surface of the substrate. Such a configuration was believed mandatory to maintain the required structural integrity of the substrate.

It is the merit of the inventors to have overcome this prejudice of the prior art by decreasing the distance of non-cylindrical through-channels to such an extent that the neighboring through-channels "overlap" each other on the upper side of the substrate. It was surprisingly found out that it is possible to do so without reducing the structural integrity of the substrate in an undue manner. With the present invention it is thus possible to increase the open area of the upper side of the substrate. It is a further merit of the inventors to have found out that by doing so the quality of the fiber web to be produced and/or finished on the PMC can be significantly improved.

In a preferred embodiment of the present invention at least 90%, preferably all, of the through-channels in the usable region of the substrate have an upper rim that directly contacts an upper rim of at least one other neighboring through-channel, preferably of all other neighboring through-channels, of the plurality of through-channels in the usable region of the substrate.

Furthermore, it is advantageous if less than 20%, preferably less than 10%, and more preferably less than 5%, of a surface on the upper side of the substrate is flat and substantially orthogonal to the thickness direction of the substrate. In other words, it is preferred if hardly any portion of the original first surface of the substrate, that was existing before the perforation process, is left after the perforation process.

In contrast to the first surface, with respect to the second surface of the substrate, it is advantageous, if between 70% and 90%, preferably between 75% and 85%, and more preferably about 80%, of a surface on the lower side of the substrate is flat and substantially orthogonal to the thickness direction of the substrate. Such a result can be achieved if the cross sectional area of the through-channels is smaller on the lower side of the substrate compared to the upper side of the substrate. For example, the through-channels may be substantially funnel-shaped tapering to the lower side of the substrate.

According to one embodiment of the present invention, the cross sectional area of at least one through-channel, preferably of all through-channels, of the plurality of through-channels in the usable region of the substrate may continuously decreases when going in the thickness direction of the substrate from the upper side to the lower side of the substrate.

According to an alternative embodiment of the present invention, the cross sectional area of at least one through-channel, preferably of all through-channels, of the plurality of through-channels in the usable region of the substrate continuously increases again when going in the thickness direction of the substrate from the middle region of the substrate between the upper side and the lower side to the lower side of the substrate. With such a configuration, the respective through-channel resembles the through-channel shown in FIG. 3*c* and the dewatering capability of the PMC may be enhanced by using the effect of a nozzle.

It is also possible to have in the same substrate a mixture of through-channels according to the two previously described embodiments.

In order to increase the density of through-channels in the usable region of the substrate, and thus, to enhance the dewatering capability of the paper machine clothing, it is suggested that at least 90% of all through-channels in the usable region of the substrate are arranged in a non-checkered pattern. Arranging the through-channels in a checkered pattern would mean that the through-channels are evenly distributed in the usable region of the PMC like the fields of a classic chess-board. In contrast to this, arranging the through-channels in a non-checkered pattern means that the through-channels are distributed differently.

According to another aspect, the present invention also refers to a method of producing the paper machine clothing as previously described comprising the following steps: providing a substrate having a first surface and a second surface, wherein the first surface and the second surface are preferably planar and parallel to each other; and forming a plurality of non-cylindrical through holes into a usable region of the substrate, wherein the plurality of through holes is formed into the substrate by using a laser and wherein preferably cold air is blown onto the substrate during the step of forming the through holes into the substrate. The cold air inhibits overheating and damaging of the substrate material, which is particularly important for the material region between two neighboring through holes when the laser is advancing form the first of the two through holes to the second one.

Preferably, at least some, more preferably all, of the plurality of through holes that are neighboring each other are formed at such a close distance that they partially overlap each other.

The term "through hole" in the sense of the present invention refers to the form of a hole that is formed in the substrate neglecting the neighboring through holes that may partially overlap. In contrast, the term "through-channel" refers to the geometric form of the channels in the finally drilled substrate. Due to the fact that neighboring through holes may overlap each other according to the present invention, its form, especially in view of its upper rim, can differ from the form of the through-channels.

According to one embodiment of the present invention it is proposed that, when all the through holes have been formed into the usable region of the substrate, at least one of the first surface and the second surface in the usable region has disappeared by at least 90%, preferably by 100%. As result the finally drilled substrate has none or hardly any opposite surface portions that are planar and parallel to each other. Preferably the substrate, before it is perforated, has a caliper in its usable region between 0.5 mm and 1.5 mm and even more preferable between 0.8 mm and 1.2 mm. After perforating the substrate in its usable region, the caliper thereof may be different. In some embodiments the caliper of the perforated substrate may be smaller compared to the substrate before perforation. This may be particularly true when at least one of the first surface and the second surface in the usable region has completely disappeared. However, in other embodiments, the caliper of the perforated substrate may be even greater compared to the substrate before perforation. This can happen if part of the material that is evaporated e.g. by means of a laser condensates again, thereby forming some kind of hills or ridges. Anyway, as previously mentioned, the topography of the substrate after the perforation process may somehow resemble the topography of an egg box.

In the following, the invention will be explained with respect to some schematic drawings that are not true to scale, wherein:

DETAILED DESCRIPTION OF THE INVENTION

Figure 1:
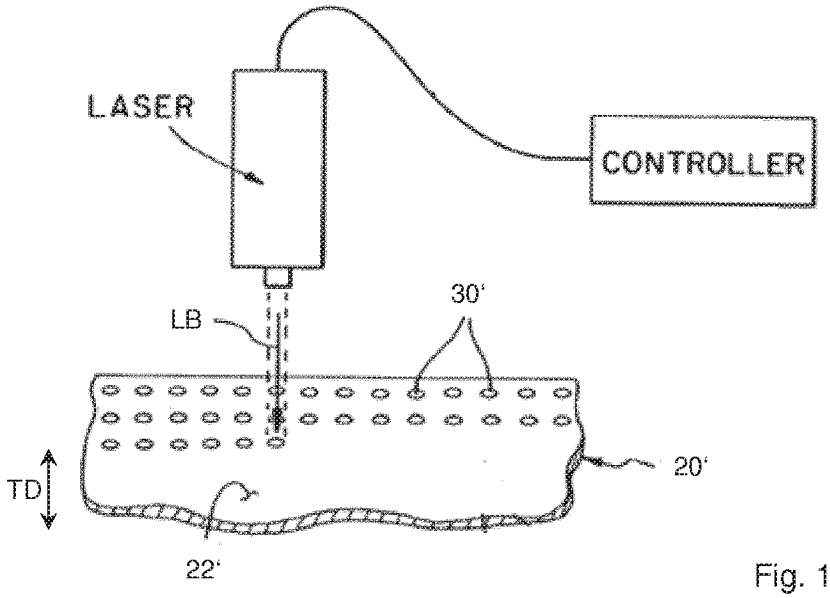
Fig. 1 (prior art)
FIG. 1 shows a method of laser drilling perforation of a substrate according to the prior art.
Figure 2:
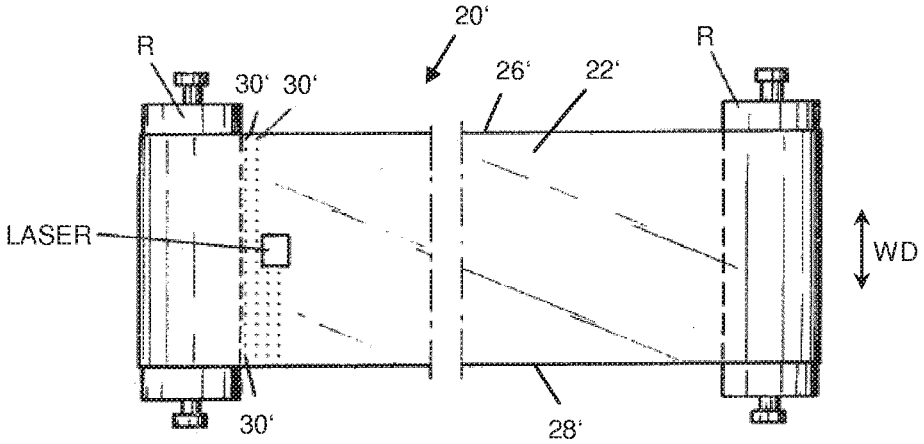
Fig. 2 (prior art)
FIG. 2 shows a substrate place under tension between two rollers according to the prior art.
Figure 3A:
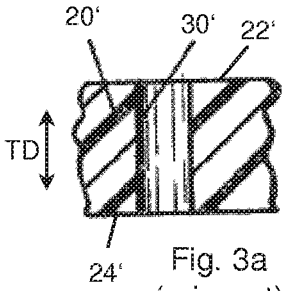
Fig. 3a (prior art)
FIG. 3*a* shows a cylindrical through section according to the prior art.
Figure 3B:
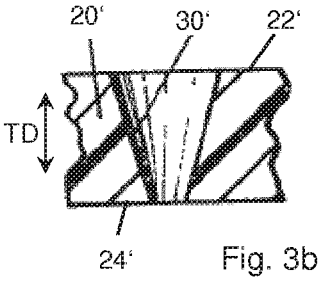
Fig. 3b (prior art)
FIG. 3*b* shows a conical through section according to the prior art.
Figure 3C:
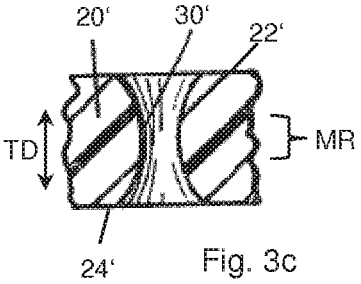
Fig. 3c (prior art)
FIG. 3*c* shows a hyperboloid through section according to the prior art.
Figure 4:
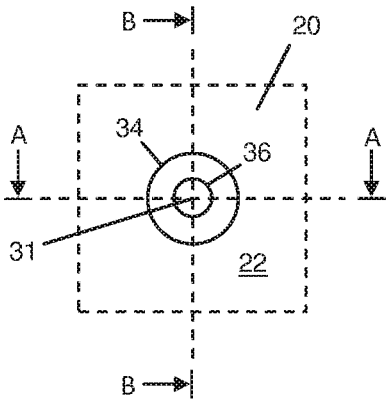
FIG. 4 shows a section of a substrate comprising a single through hole of a first type not forming part of the present invention.

FIG. 4 shows a section of a substrate 20 which section is indicated by a dashed square. The substrate 20 comprises a first surface 22 and an opposite second surface 24 (see FIG. 6), wherein the first surface 22 and the second surface 24 are substantially planar and parallel to each other.

Figure 6:
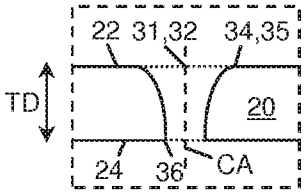
FIG. 6 shows a sectional view along lines A-A and B-B in FIG. 4 and along line C-C in FIG. 5.

A single through hole 31 of a first type not forming part of the present invention is provided in the center of the section of the substrate 20. FIG. 6 shows a cross sectional view which is taken through the through hole 31 along line A-A or line B-B of FIG. 4. As can be seen from FIGS. 4 and 6, the through hole 31 extends through the substrate 20 in its thickness direction TD along a central axis CA of the through hole 31, the central axis CA being indicated by a dashed line in FIG. 6. Thus, the through hole 31 connects the first surface 22 with the second surface 24 of the substrate 20. The through hole 31 is substantially funnel shaped with a cross sectional area becoming continuously smaller when going in the thickness direction TD from the first surface 22 to the second surface 24. The cross sectional area of a through hole 31 is obtained by cutting the through hole 31 with a plane that is oriented perpendicular to the thickness direction TD of the substrate 20. In this embodiment that does not belong to the present invention the shape of the cross sectional area of the through hole 31 is always circular, no matter at which height level of the substrate the cross sectional area is taken.

Figure 4A:
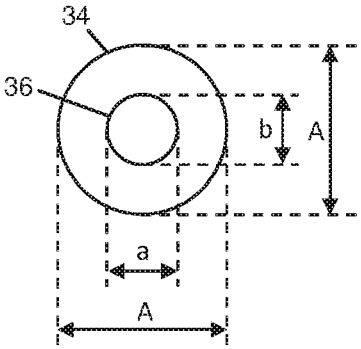
FIG. 4*a* shows an enlarged view of the through hole in FIG. 4 not forming part of the present invention.

The through hole 31 has a circular upper rim 34 where a side wall of the through hole 31 ends and the flat first surface 22 begins. The circular upper rim 34 has a diameter A, as shown in FIG. 4*a*. Furthermore, the through hole 31 has a circular lower rim 36 where the side wall of the through hole 31 ends and the flat second surface 24 begins. The circular lower rim 36 has a diameter a, as also shown in FIG. 4*a*. Diameter A of the upper rim is larger than diameter a of the lower rim.

Figure 5:
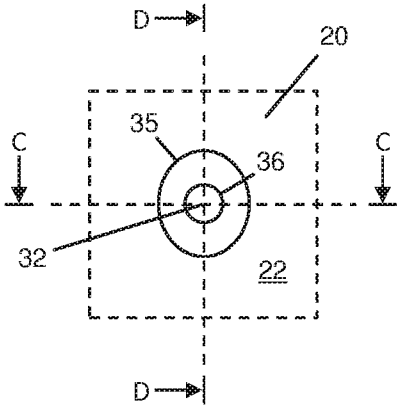
FIG. 5 shows a section of a substrate comprising a single through hole of a second type according to the present invention.

FIG. 5 shows another section of a substrate 20 which section is also indicated by a dashed square. The substrate 20 comprises a first surface 22 and a second surface 24 (see FIG. 7), wherein the first surface 22 and the second surface 24 are substantially planar and parallel to each other.

Figure 7:
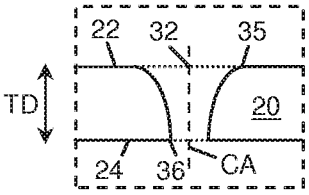
FIG. 7 shows a sectional view along line D-D in FIG. 5.

A single through hole 32 of a second type according to the present invention is provided in the center of the section of the substrate 20. FIG. 6 shows a cross sectional view which is taken through the through hole 32 along line C-C of FIG. 5 and FIG. 7 shows a cross sectional view which is taken through the through hole 32 along line D-D of FIG. 5. As can be seen from FIGS. 5, 6 and 7, the through hole 32 extends through the substrate 20 in its thickness direction TD along a central axis CA of the through hole 32, the central axis CA being indicated by a dashed line in FIGS. 6 and 7. Thus, the through hole 32 connects the first surface 22 with the second surface 24 of the substrate 20. The through hole 32 is substantially funnel shaped with a cross sectional area becoming continuously smaller when going in a thickness direction TD from the first surface 22 to the second surface 24. The cross sectional area of the through hole 32 is obtained by cutting the through hole 32 with a plane that is oriented perpendicular to the thickness direction TD of the substrate 20. In this embodiment the shape of the cross sectional area of the through hole 32 is not constant, what is according to the present invention, but changes when going along the thickness direction TD of the through hole 32. In an upper region of the substrate 20, i.e. in a region close to the first surface 22, the through hole 32 is more oval or elliptical, whereas in a lower region of the substrate 20, i.e. in a region close to the second surface 24, the through hole 32 is more or completely circular. The shape of the cross sectional area of the through hole 32 preferably changes continuously along the thickness direction TD of the substrate 20.

Figure 5A:
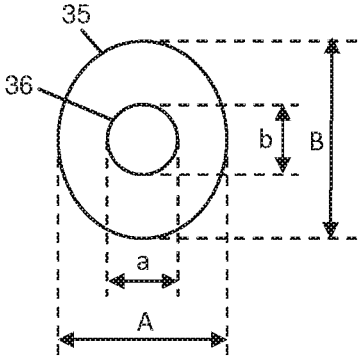
FIG. 5*a* shows an enlarged view of the through hole in FIG. 5 according to the present invention.

Thus, the through hole 32 has an elliptical upper rim 35 where a side wall of the through hole 32 ends and the flat first surface 22 begins. The elliptical upper rim 35 has a first diameter A and a second diameter B measured orthogonally thereto, as indicated in FIG. 5*a*. Furthermore, the through hole 32 has a circular lower rim 36 where the side wall of the through hole 32 ends and the flat second surface 24 begins. The circular lower rim 36 has a diameter a, as also shown in FIG. 5*a*. The second diameter B of the upper rim 35 is larger than the first diameter A of the upper rim 35. The first diameter A of the upper rim 35 is larger than the diameter a of the lower rim 36. Preferably, the second diameter B of the upper rim 35 is at least 5%, more preferably at least 10%, even more preferably at least 15% larger than the first diameter A of the upper rim 35.

Figure 8:
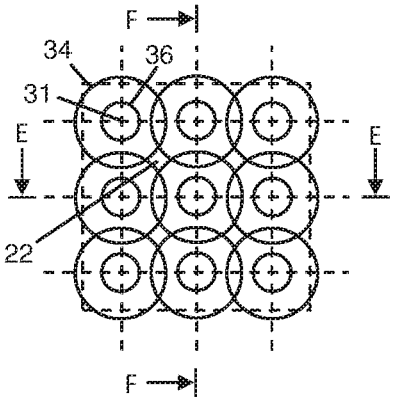
FIG. 8 shows a section of a substrate comprising a plurality of through holes of the first type not forming part of the present invention.
Figure 9:
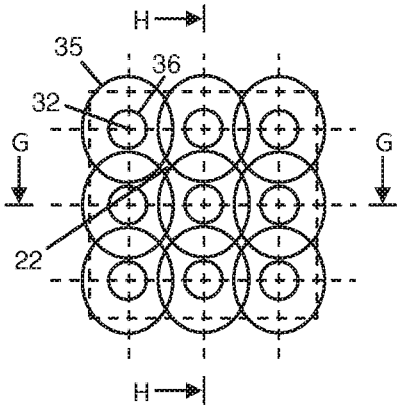
FIG. 9 shows a section of a substrate comprising a plurality through holes of the second type according to the present invention.

According to an advantageous embodiment of the present invention, several of such non-cylindrical through holes are arranged in such a close relationship that they partially overlap each other in the substrate. Examples of such arrangements for the through holes 31 of the first type and the through holes 32 of the second type are shown in FIGS. 8 and 9, respectively. To be more precise, nine corresponding through holes 31, 32 arranged in a checkered pattern are shown in these figures. The through holes 31, 32 each have a respective lower rim 36. Furthermore, for the sake of clarity, also the corresponding upper rims 34, 35 of the through holes 31, 32 are shown, even though these upper rims 34, 35 do not exist anymore as such in the final product. Instead, in the final product, i.e. in the finally perforated substrate 20, through-channels 30 are formed having a respective upper rim 38 that is at least partially delimited by the upper rim 38 of a neighboring through-channel 30. As shown in FIGS. 8 and 9, the originally existing flat or planar first surface 22 of the substrate 20 has almost completely disappeared after the perforation of the substrate 20 in the usable region UR thereof. In alternative embodiments it may have completely disappeared. One reason for the complete disappearance of the originally flat first surface 22 of the substrate 20 could be that the distance between the through holes 31, 32 is chosen even smaller than shown in FIGS. 8 and 9 (as will be explained below in view of FIGS. 13 and 14). An additional or alternative reason for the complete disappearance of the originally flat first surface 22 of the substrate 20 could be that the through holes 31, 32 have been laser-drilled and that the material of the substrate 20 that has been evaporated by the energy of the laser at least partially condensates again on the first surface 22, thus forming some kind of hill or ridge thereon. As a consequence, the upper rim 38 of a corresponding through-channel 30 does not necessarily extend within a plane but is rather a closed line that extends three-dimensionally. It should be noted that the upper rim 38 of the through-channel 30 may extend partially below the originally flat first surface 22 of the substrate 20 and/or extend partially above the originally flat first surface 22 of the substrate 20.

Figure 10:
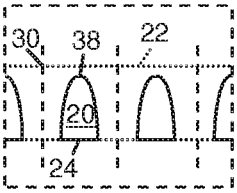
FIG. 10 shows a sectional view along lines E-E and F-F in FIG. 8 and along line G-G in FIG. 9.
Figure 11:
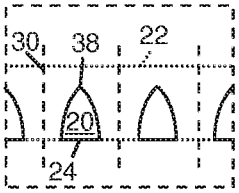
FIG. 11 shows a sectional view along line H-H in FIG. 9.

FIGS. 10 and 11 represent views similar to the ones shown in FIGS. 6 and 7, respectively, but now with several neighboring through holes 31, 32 that form the through-channels 30 in the substrate 20 of the final product. In FIG. 10 a location (see reference sign 38) of the upper rim 38 of the through-channel 30 of FIG. 8 is shown that represents an absolute minimum of the upper rim 38. In other words, the upper rim 38 has the largest distance to the originally flat first surface 22 of the substrate 20 which surface 22 is indicated by a dotted line in FIG. 10. The surface of the substrate 20 has a saddle point at this location of the upper rim 38.

In FIG. 11 a location (see reference sign 38) of the upper rim 38 of the through-channel 30 of FIG. 9 is shown (according to the section along line H-H of FIG. 9) that represents an absolute minimum of the upper rim 38 of this through-channel 30. In other words, the upper rim 38 has the largest distance to the originally flat first surface 22 of the substrate 20 which surface 22 is also indicated by a dotted line in FIG. 11. The surface of the substrate 20 has a saddle point at this location of the upper rim 38. A section along line G-G of FIG. 9 is represented by the drawing of FIG. 10. At the location of the upper rim 38 shown in this figure, the upper rim only has a local minimum. Thus, the ridges that separate two neighboring through-channels 30 from each other are higher when following the line G-G compared to the ridges when following the line H-H of FIG. 9. Consequently, the substrate has anisotropic properties.

These anisotropic properties can be used in a beneficial way. For example, the substrate that is perforated in a way as shown in FIGS. 9, 10 and 11 is more stress resistant in the direction parallel to line H-H compared to the direction parallel to line G-G. If line H-H substantially represents the machine direction of the final paper machine clothing the relatively high forces in the machine direction can be absorbed by the substrate 20 while at the same time the substrate 20 provides a relatively large open area on its upper side. Alternatively, if line H-H substantially represents the cross machine direction of the final paper machine clothing the nascent paper web in a forming section can adhere better to the substrate 20 since ridges formed in the substrate 20 between neighboring rows of through channels 30 that extend in cross machine direction are higher than those extending in the machine direction. Consequently, the properties of the substrate 20 can be adjusted to the intended use or the requirements of the paper machine clothing.

Figure 12:
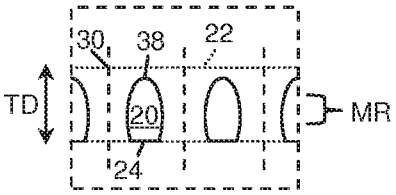
FIG. 12 shows a sectional view similar to the sectional view of FIG. 10, but with a third type of through holes.

FIG. 12 shows a sectional view similar to the cross sectional view of FIG. 10, but of a third type of through holes. This third type of through holes differs from the first and second type of through holes 31, 32 in that the cross sectional area of the through hole of the third type and, thus, the cross sectional area of the corresponding through-channel 30 that is created thereof, continuously increase again when going in the thickness direction TD of the substrate 20 from the middle region MR of the substrate 20 between the upper side and the lower side to the lower side of the substrate 20. In an extreme case, neighboring through holes may not only partially overlap each other on the first side 22 of the substrate 20 but also on the second side 24 thereof.

Figure 13:
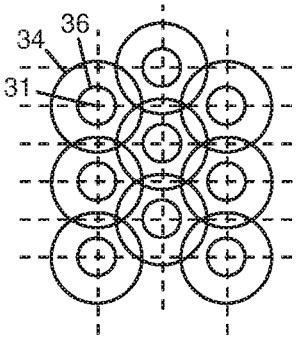
FIG. 13 shows a section of a substrate similar to the one shown in FIG. 8 not forming part of the present invention, but with the through holes are arranged in a non-checkered pattern.
Figure 14:
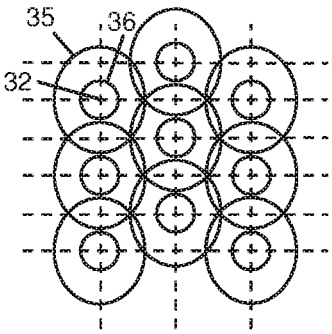
FIG. 14 shows a section of a substrate similar to the one shown in FIG. 9 according to the present invention, but with the through holes are arranged in a non-checkered pattern.

Finally, FIGS. 13 and 14 show a section of a substrate 20 similar to the one shown in FIGS. 8 and 9, respectively, with the difference that the through holes 31, 32 are arranged in a non-checkered pattern. In FIGS. 8 and 9 each through hole 31, 32 has eight neighboring other through holes 31, 32 wherein the distance to four of these eight neighboring through holes 31, 32 is larger than the distance to the remaining four neighboring through holes 31, 32. Small areas of the originally flat first surface 22 of the substrate 20 are still left.

In contrast, in the examples shown in FIGS. 13 and 14, each through hole 31, 32 has six neighboring other through holes 31, 32 wherein the distance to all these neighboring through holes 31, 32 is substantially the same (for example corresponding to the smaller distance of the embodiments shown in FIGS. 8 and 9). These six neighboring through holes 31, 32 are arranged in a honeycomb pattern around a corresponding through hole 31, 32 in the middle thereof. No areas of the originally flat first surface 22 of the substrate 20 are left after the perforation processes. With such an arrangement, the density of through-channels 31 in the final substrate 20 can be increased, as well as the open area on the upper side of the substrate 20.

LIST OF REFERENCE SIGNS

20', 20 substrate
22, 22' first surface
24, 24' second surface
26' first lateral edge
28' second lateral edge
30', 30 through-channel
31 through hole of first type
32 through hole of second type
34 circular upper rim of through hole
35 elliptical upper rim of through hole
36 circular lower rim of through hole
38 upper rim of through-channel
a, b diameter of lower rim
A, B diameter of upper rim
CA central axis
LB laser beam
MR middle region
R roller
TD thickness direction
WD width direction

The invention claimed is:

1. A paper machine clothing, comprising:

a substrate having an upper side, a lower side, two lateral edges, and a usable region between said two lateral edges;

said usable region having a plurality of through-channels formed therein extending through said substrate and connecting said upper side with said lower side;

said through-channels being non-cylindrical, with a cross sectional area becoming smaller in a thickness direction of said substrate from said upper side to a middle region of said substrate between said upper side and said lower side; and a shape of the cross sectional area of at least one of said through-channels changing in the thickness direction of the substrate proceeding from said upper side to said lower side.

2. The paper machine clothing according to claim 1, wherein the shape of all of said through-channels of the plurality of through-channels changes in the thickness direction from said upper side to said lower side.

3. The paper machine clothing according to claim 1, wherein the shape of the cross sectional area is substantially more elliptical in an upper region of said through-channel than in a lower region of said through-channel.

4. The paper machine clothing according to claim 1, wherein the shape of the cross sectional area in the upper region of said through-channel has a first dimension extending in cross-machine direction and a second dimension extending in machine direction, and wherein the first dimension is smaller than the second dimension.

5. The paper machine clothing according to claim 1, wherein the shape of the cross sectional area in the upper region of said through-channel has a first dimension extending in cross-machine direction and a second dimension extending in machine direction, and wherein the first dimension is larger than the second dimension.

6. The paper machine clothing according to claim 1, wherein the shape of the cross sectional area at said lower side of said substrate is substantially circular.

7. The paper machine clothing according to claim 1, wherein an upper rim of at least one of the plurality of said through-channels directly contacts an upper rim of at least one other neighboring through-channel of the plurality of said through-channels.

8. The paper machine clothing according to claim 7, wherein at least 90% of said through-channels in said usable region of said substrate have an upper rim that directly contacts an upper rim of at least one other neighboring through-channel of the plurality of through-channels in said usable region of said substrate.

9. The paper machine clothing according claim 8, wherein all of said through-channels in said usable region of said substrate have an upper rim that directly contacts an upper rim of all other neighboring through-channels of the plurality of through-channels in said usable region of said substrate.

10. The paper machine clothing according to claim 1, wherein less than 20% of a surface on said upper side of said substrate is flat and substantially orthogonal to the thickness direction of said substrate.

11. The paper machine clothing according to claim 10, wherein less than 5% of the surface on said upper side of said substrate is flat and substantially orthogonal to the thickness direction of said substrate.

12. The paper machine clothing according to claim 1, wherein between 70% and 90% of a surface on said lower side of said substrate is flat and substantially orthogonal to the thickness direction of said substrate.

13. The paper machine clothing according to claim 12, wherein approximately 80% of the surface on said lower side of said substrate is flat and substantially orthogonal to the thickness direction of said substrate.

14. The paper machine clothing according to claim 1, wherein the cross sectional area of said through-channels in said usable region of said substrate continuously decreases proceeding in the thickness direction of said substrate from said upper side to said lower side of said substrate.

15. The paper machine clothing according to claim 1, wherein the cross sectional area of said through-channels in said usable region of said substrate continuously decreases in the thickness direction of said substrate from said upper side to the middle region of said substrate, and increases again in the thickness direction of said substrate from the middle region of said substrate to said lower side of the substrate.

16. The paper machine clothing according to claim 1, wherein at least 90% of said through-channels in said usable region of said substrate are arranged in a non-checkered pattern.

17. A method of producing the paper machine clothing according to claim 1, the method comprising the following steps:

providing a substrate having a first surface and a second surface; and forming a plurality of non-cylindrical through holes into a usable region of the substrate with a laser and cooling the substrate during the step of forming the through holes.

18. The method according to claim 17, wherein the step of cooling the substrate comprises blowing cold air onto the substrate during the step of forming the through holes with the laser.

19. The method according to claim 17, wherein at least some of the plurality of through holes that are neighboring each other are formed at such a close distance that the neighboring through holes partially overlap each other.

20. The method according to claim 17, which comprises forming the through holes such that, when all of the through holes have been formed into the usable region of the substrate, at least one of the first surface or the second surface in the usable region has disappeared by at least 90%.

* * * * *